United States Patent [19]

Flumignan et al.

[11] Patent Number: 4,771,141

[45] Date of Patent: Sep. 13, 1988

[54] PUSH-PUSH ELECTRICAL SWITCH

[75] Inventors: Dennis P. Flumignan, Sterling Heights, Mich.; Mark A. Cruz, Fort Wayne, Ind.

[73] Assignee: Zanxx, Inc., Avilla, Ind.

[21] Appl. No.: 80,646

[22] Filed: Jul. 31, 1987

[51] Int. Cl.[4] ..... H01H 13/58

[52] U.S. Cl. ..... 200/153 J

[58] Field of Search ..... 200/153 J

[56] References Cited

U.S. PATENT DOCUMENTS

| | | | |
|---|---|---|---|
| 729,772 | 6/1903 | Kastenhuber . | |
| 2,096,386 | 10/1937 | Taubner | 200/64 |
| 2,935,394 | 5/1960 | Coronado-Arce et al. | 74/503 |
| 2,945,111 | 7/1960 | McCormick | 200/160 |
| 3,523,168 | 8/1970 | Holmes | 200/159 |
| 3,542,988 | 11/1970 | Baldasare | 200/153 J |
| 3,598,948 | 10/1971 | Bowen et al. | 200/159 R |
| 3,694,603 | 9/1972 | Congelliere et al. | 200/153 J |
| 4,175,222 | 10/1979 | Buttner | 200/159 R |
| 4,225,764 | 9/1980 | Buttner | 200/159 R |
| 4,288,670 | 9/1981 | Buttner | 200/303 |
| 4,293,751 | 10/1981 | Van Benthuysen et al. | 200/156 |
| 4,308,440 | 12/1981 | Buttner | 200/303 |
| 4,317,015 | 2/1982 | Buttner et al. | 200/153 J |
| 4,345,128 | 8/1982 | Buttner et al. | 200/153 J |
| 4,463,231 | 7/1984 | Cooper et al. | 200/153 J |
| 4,495,391 | 1/1985 | Kitao et al. | 200/153 J |
| 4,506,124 | 3/1985 | Rose et al. | 200/153 J |

*Primary Examiner*—Renee S. Luebke

*Attorney, Agent, or Firm*—Jeffers, Hoffman & Niewyk

[57] ABSTRACT

A pushbutton switch uses a push/turn actuator having an axially movable button which engages and rotationally indexes a rotary actuator. A rotary switch mechanism is positioned coaxially with the actuator and includes a rotor having a cam surface lying in a cam plane perpendicular to the axis of the actuator. The cam and rotary actuator are coupled, preferable by an axially slidable drive shaft, so that rotary movement of the actuator causes like rotary movement of the rotor while axial movement of the actuator causes no corresponding axial movement of the rotor. The cam surface engages one or more movable, spring biased contacts for a wiping contacting motion of said contact as the rotor is rotated. The movement of the contacts occurs in the cam plane. An indexing mechanism provides for the switching action to occur upon release of the push button.

29 Claims, 4 Drawing Sheets

PUSH-PUSH ELECTRICAL SWITCH

BACKGROUND OF THE INVENTION

This invention relates to a push button electrical switch and in particular, to a low cost push button switch which has a long life and which is reliable in operation.

Push button electrical switches are well known in the prior art and are used in a variety of applications, such as, for instance, in automotive applications for controlling one or more low voltage circuits.

U.S. Pat. No. 3,694,603 discloses a push button switch including an indexing movement wherein operation of the push button causes a conductive contactor to move axially and, at a particular axial position, to bridge two terminals for completing the circuit.

One problem with this prior art push button switch is the fact that, if the switch is in its closed state, only a small amount of movement of the push button will cause the contactor to move axially out of contact with the terminals, thereby immediately breaking the electrical circuit. Thus the push button may be manipulated by the operator, or in certain situations, may be operated by vibrations of the equipment in which the switch is mounted, to cause the switch to open without positive and complete actuation of the switch. It is therefore desired to provide a push button electrical switch wherein the closing and opening of the switch is positively controlled, thereby preventing accidental or intermittent opening of the switch.

A further problem with the aforementioned prior art push button switch is the fact that the push button has two rest positions. In a first position, when the switch is closed and the contactor bridges the terminals, the push button is in its uppermost rest position. When the push button is actuated in order to open the switch, the contactor is axially positioned to remain out of contact with the terminals whereby the push button itself occupies an axially different rest position than in the closed position of the switch. This is undesirable in certain applications when it is desired that the push button occupies the same rest position regardless of whether the switch is in its closed or open state.

A still further problem with the aforementioned prior art push button switch is that it is subject to excessive wear and therefore has a limited life. This wear is due to the fact that the contactor operates linearly axially and always contacts the same contact points on the terminals. This causes arcing of the contacts, thereby removing metal from the contact points and also causing deposits to be formed on the contact points. Eventually, the contact points will be worn or deposits will accumulate to such an extent that high electrical resistance is built up at the contact points of the contactor and terminals. Alternatively, contact may even be entirely prevented thus causing complete failure of the switch.

It is therefore desired to provide a compact electrical push button switch which is not subject to wear because of arcing and therefore has a long life as compared to the above mentioned prior art switch and requires positive push button operation for the switch to change states. Furthermore, it is desired to provide a push button switch wherein the push button always returns to the same position.

SUMMARY OF THE INVENTION

The present invention overcomes the disadvantages of the above described prior art push button switches by providing an improved push button switch therefor.

The push button switch according to the instant invention, in one form thereof, provides a push button switch wherein the movement of the push button is axial but generates a rotational indexing movement of a camming device, thereby opening and closing the switch. The movement of the camming device is such that the push button must be positively and completely actuated to provide for a complete indexing movement of the cam so that operation of the switch may occur. Furthermore, the making or breaking movement of the electrical contacts is instantaneous, thereby reducing arcing. Lastly, the operation of the cam induces a wiping movement of the terminal with the contactor blade thereby providing a greater wear area for the switch contacting surfaces and reducing wear and potential failure of the switch.

The switch according to the present invention, in one form thereof, includes a push button, an actuator, and a rotor having at least one camming surface. Axial operation of the push button initiates rotation of the actuator. The actuator is rotationally locked to the rotor and therefore actuation of the push button also generates an initial segment of rotational movement of the rotor. When the push button is released, the actuator is permitted to move axially, under the biasing force of a spring, to return to its rest position. This axial movement of the actuator causes the actuator to be further indexed rotationally and to carry the rotor rotationally along with it through a second segment of rotational movement, thereby either opening or closing the switch. Thus, release of the push button causes the actual opening or closing of the switch. It is therefore not possible to open the electrical circuit by partially operating the push button, as the partial operation will not cause the rotor to be rotated through the first segment and therefore does not permit the rotor to complete its rotational movement upon release of the push button. Furthermore, the push button always returns to the same rest position upon its release. Finally, the contactor blade and terminal are mounted as cantilevers, thereby causing wiping movement of the terminal contacting area with the blade which tends to clean the contacting surfaces and also provides a larger contacting area than was provided by prior art push button switches. Therefore wear of the contact areas will not adversely affect the operation of the switch and the life of the switch is greatly extended as compared with prior art switches.

Another advantage of the switch according to the present invention is that the making and breaking movement of the electrical contacting surfaces is rapid, thereby reducing arcing and wear of the switch.

A still further advantage of the present invention is that alignment of the contacting surfaces is established by the wiping action of the contacting surfaces, thereby providing positive alignment and eliminating possible misalignment thereof.

A still further advantage of the present invention is that the switch may simultaneously operate more than one set of contacts by the simple addition of further camming surfaces. The terminal is bifurcated and the bifurcated legs operate in different planes. Therefore, by the simple addition of an additional camming surface in a different plane and by providing additional terminal legs, a multiple switch may be provided. Further, movable electrical contacts could be provided at various circumferential positions surrounding a single rotary cam element.

Because of its unique construction, the switch is capable of handling relatively large current loads, while retaining the advantage of being very compact and efficient.

The present invention, in one form thereof, comprises a push button electrical switch for selectively interconnecting a plurality of electrical conductors by the operation of a push button. The switch includes a housing having a generally cylindrical bore therein and a push button which is axially slidably received in the bore. An actuator is axially moveably disposed with respect to the push button and is adapted to rotate with respect to the housing upon axial movement of the push button relative to the housing. A rotor is axially moveably disposed and rotatably fixed with respect to the actuator and includes a switch camming surface which is disposed radially outwardly from the axis of rotation of the rotor. A blade and terminal are disposed adjacent the camming surface, the blade being biased resiliently inwardly toward the switch camming surface whereby, upon axial movement of the push button, the switch camming surface causes the terminal to move toward or away from the blade in a plane which is substantially transverse to the axis of the rotor.

The present invention, in one form thereof, further comprises a push button electrical switch for electrically interconnecting a plurality of electrical conductors. The switch includes a housing having a generally cylindrical bore therein and an elongated push button axially slidably received in the bore. The forward end of the push button includes a generally circular first camming surface. An actuator is axially movably arranged with respect to the push button, the actuator having a circular second camming surface for engaging the first camming surface and thereby causing the actuator to rotate with respect to the housing upon axial movement of the push button relative to the housing. A rotor which is axially movable relative to the actuator and rotationally fixed with respect thereto includes a switch camming surface disposed radially outwardly from the axis of rotation of the rotor. A resilient blade is disposed adjacent to and biased toward the switching surface. A cantilevered terminal is disposed between the blade and the switch camming surface, whereby, upon rotation of the rotor, the terminal is moved radially inwardly or outwardly by the camming surface thereby causing at least a portion of the terminal to wipe across at least a portion of the blade and making or breaking the switch.

The present invention comprises, in one form thereof, a push button electrical switch for selectively interconnecting a plurality of electrical conductors. The switch includes a housing having a generally cylindrical bore therein and a plurality of elongated, evenly spaced, radially inwardly extending, first ribs arranged circumferentially around the bore and defining first guideways therebetween, the forward ends of the ribs including shoulders defining first camming ramps. An elongated cylindrical push button is axially slidably received in the bore and has evenly spaced lugs arranged around its circumference for sliding cooperation with the first guideways and for preventing rotation of the push button relative to the housing. The forward end of the push button includes a generally circumferential toothed first camming surface. An actuator is slidably and rotatably associated with respect to the housing and includes a generally cylindrical toothed second camming surface for cooperating with the first camming surface and causing the actuator to selectively rotatingly index with respect to the housing. The actuator includes a plurality of second lugs for cooperating with the first guideways and for selectively preventing rotation of the actuator with respect to the housing. The ends of the second lugs define second camming ramps. A spring is provided for urging the actuator toward the push button. A rotor is axially moveably disposed with respect to the actuator and rotationally locked thereto. The rotor includes a switch camming surface circumferentially arranged with respect to the axis of the bore. A blade is mounted in the housing radially outwardly of the switch camming surface. A cantilevered terminal is mounted between the blade and the switch camming surface and is arranged to be selectively cammed into and out of contact with the blade for opening and closing the switch upon rotation of the rotor.

It is an object of the present invention to provide a compact efficient switch having a long life and excellent reliability.

It is a further object of the present invention to provide a switch wherein the switching is accomplished positively so that the opening and closing operations of the switch are not effected by vibration or inadvertent incomplete operation of the push button.

It is a still further object of the present invention to provide a switch wherein the breaking or making of the switch is effected rapidly.

Yet a further object of present invention is to provide a switch which incorporates wiping action between the contacting surfaces of the switch.

A still further object of the present invention is to prevent misalignment of the electrical contact areas of the switch by providing a wiping action of the switch.

Yet another object of the present invention is to provide a switch wherein the terminal contactors may operate in different planes.

BRIEF DESCRIPTION OF THE DRAWINGS

The above mentioned and other features and objects of this invention, and the manner of attaining them, will become more apparent and the invention itself will be better understood by reference to the following description of an embodiment of the invention, taken in conjunction with the accompanying drawings wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DESCRIPTION OF THE PREFERRED EMBODIMENT

Figure 1:
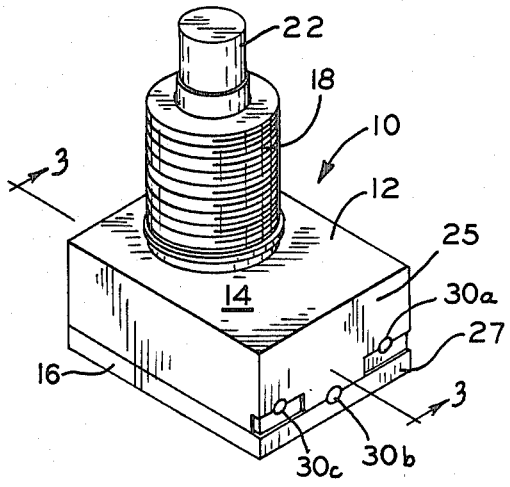
FIG. 1 is a perspective view of the switch assembly.

Referring to FIG. 1, there is shown a perspective view of the switch assembly 10 including a housing 12 having an upper housing portion 14 and a cover 16. Upper portion 14 of the housing 12 may include an externally threaded barrel 18 on which a nut (not shown) may be threaded for securing the switch assembly to a suitable panel or the like.

Figure 2:
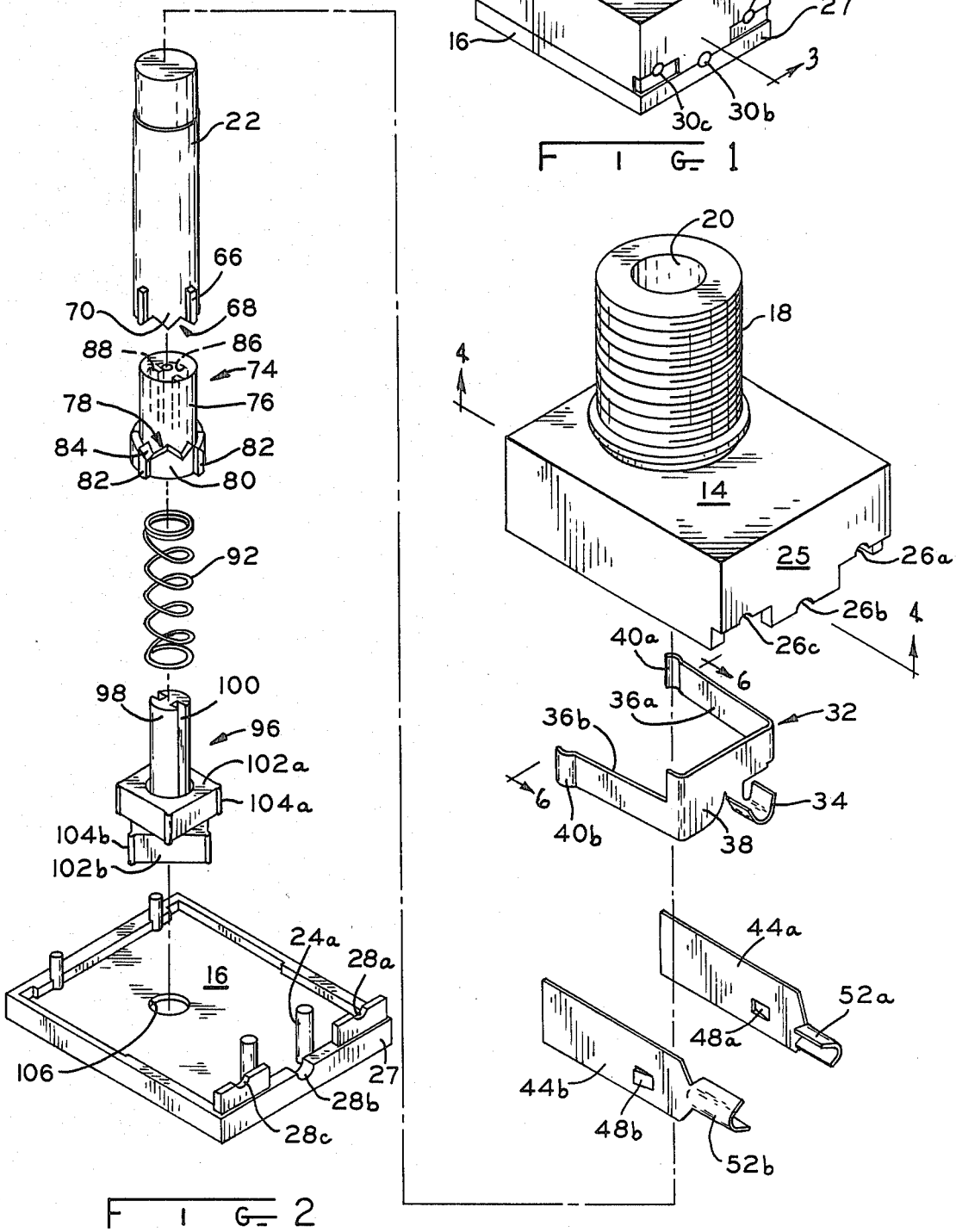
FIG. 2 is a perspective exploded view of the switch assembly of FIG. 1.
Figure 4:
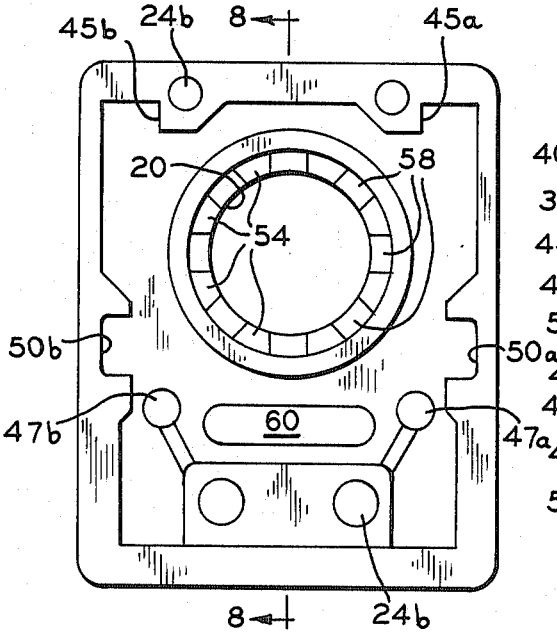
FIG. 4 is a bottom plan view of the upper housing portion of the switch of FIG. 1.

Referring now to FIG. 2, barrel 18 includes a bore 20 into which an elongated push button 22 is axially slidably received. In the disclosed embodiment, push button 22 is cylindrical. Cover 16 is assembled to upper housing portion 14 by means of pins 24*a* which engage functionally with apertures 24*b* as best shown in FIG. 4 and align cover 16 with upper housing portion 14. Thus, to assemble cover 16 to upper housing portion 14, the cover 16 is pushed onto upper housing 14 whereby pins 24*a* will be in frictional engagement with apertures 24*b*.

The wall 25 of upper housing portion 14 and the wall 27 of cover 16 respectively include semi-cylindrical depressions 26*a*–26*c* and 28*a*–28*c* to form apertures 30*a*, 30*b*, and 30*c* in assembled housing 12, as best seen in FIG. 1. These apertures 30*a*–30*c* provide access into housing 12 by suitable leads (not shown).

Figure 6:
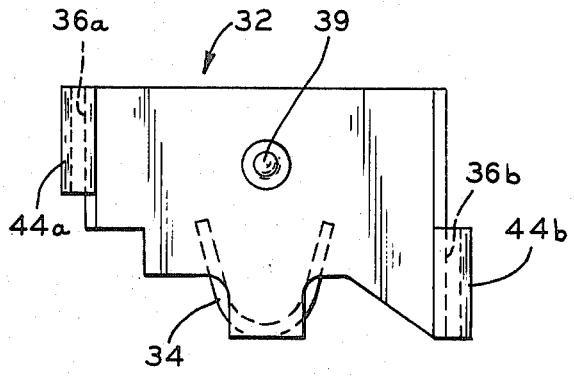
FIG. 6 is an end view of the terminal of the switch of FIG. 1.

Further referring to FIG. 2, a terminal 32 is provided including a connecting ear 34 which may be crimped to a suitable lead (not shown) for contact therewith in well-known fashion. Alternatively, a solder connection may be made between ear 34 and a lead. Terminal 32 is U-shaped or bifurcated and includes two legs 36*a* and 36*b* and a bight 38 for connecting the leads. As best seen in FIGS. 2 and 6, terminal 32 has the legs 36 thereof formed in two planes which planes are horizontal in the orientation of terminal 32 as shown in FIG. 2. Thus terminal 32 is tiered as further explained hereinafter. As best seen in FIG. 6, dimple 39 is also provided on the inside surface of bight 38 to provide frictional contact of terminal 32 with upper housing portion 14. Each of the legs 36 includes a contacting wiper portion 40 which is rounded in shape to provide for wiping action of the terminal as further discribed hereinafter. The terminal may be constructed of resilient hard brass of a thickness of approximately 0.008 inches. However terminals made of various other materials or terminals of various thicknesses may also be used, as desired. The housing 12, including the upper housing portion 14, cover 16 and button 22 are preferably constructed of an insulating material such as molded plastic, as is conventional.

Referring further to FIG. 2, blades 44*a* and 44*b* are provided. These blades include struck out portions 48*a* and 48*b* and connecting ears 52*a* and 52*b*. By referring to FIG. 5, it can be seen that struck out portions 48*a* and 48*b* are located in pockets 50*a* and 50*b* of upper housing portion 14. Furthermore, the respective ends of blades 44*a* and 44*b* adjacent to struck out portions 48*a* and 48*b* are respectively captured between pins 47*a* and 47*b* and shoulders 46*a* and 46*b* whereby each blade 44*a* and 44*b* is cantilevered. The opposite ends of blades 44*a* and 44*b*, in the rest position of the blades wherein no contact is made with the terminal 32, will respectively bottom out against shoulder 45*a* and 45*b* of upper housing cover 14. Th blades 44*a* and 44*b* are thus mounted as cantilevered beams. It should also be noted that the blades 44 are bent slightly inwardly for bottoming out against shoulders 45 in the open position of the switch. The blades may be manufactured of a hard resilient hard brass of a thickness of approximately 0.008 inches.

Figure 5:
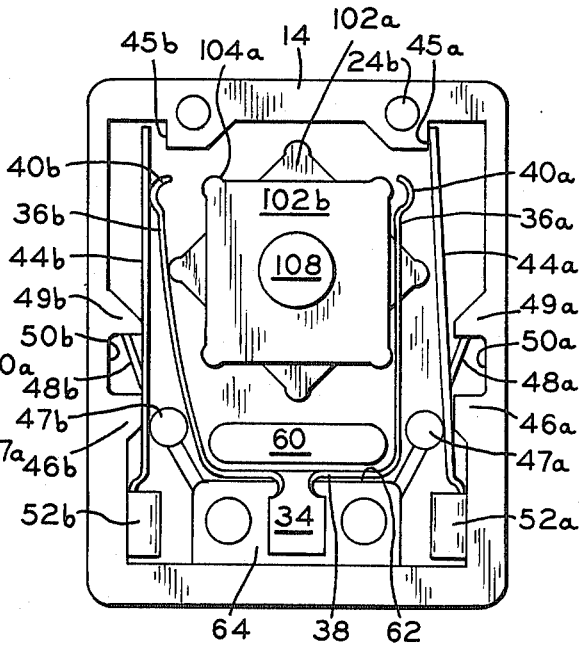
FIG. 5 is a cross sectional view of the switch assembly of FIG. 3 taken along line 5—5 of FIG. 3.
Figure 7:
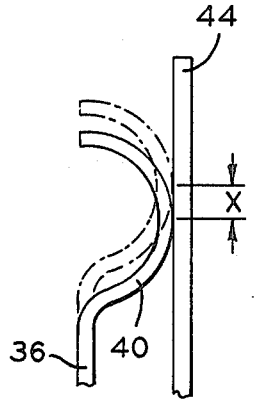
FIG. 7 is an enlarged partial view of the contacting areas of the switch of FIG. 1.

As best seen in FIG. 5, on the left hand side thereof, in the contact position wherein terminal leg 36*b* contacts blade 44*b*, blade 44*b* is moved away from its rest position against shoulder 45*b*. As seen in FIG. 7, which illustrates the wiping action of terminal 32, wiper portion 40, in the solid line position, begins to make contact with blade 44. In the dotted line position, the contacting movement has been completed. It can be seen that the point of contact between wiper 40 and blade 44 moves over a distance "X" during the wiping action of wiper 40 and blade 44 when the switch is opened or closed. This movement ensures that wear of the contacting surfaces is made over a portion of the blade rather than at a single point, thereby causing cleaning action of the surfaces and extending the life of the contact structure.

Figure 13:
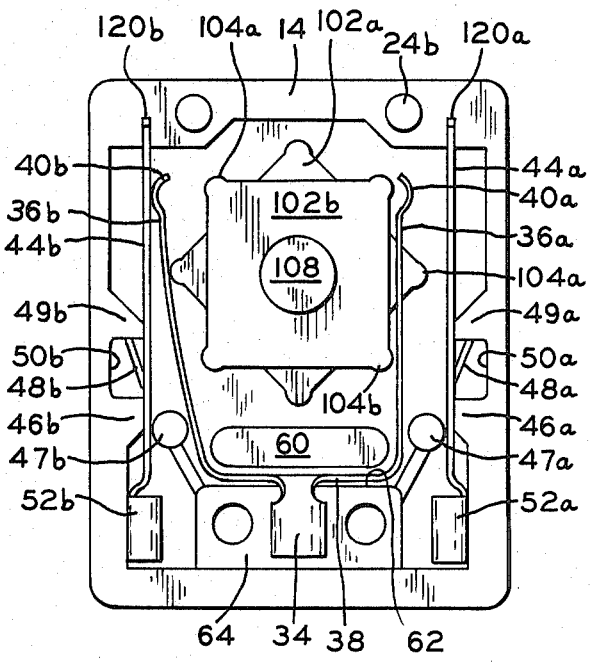
FIG. 13 is a cross sectional view of an alternative embodiment of the switch assembly.

In an alternative embodiment shown un FIG. 13, blades 44*a* and 44*b* may be mounted so that the ends thereof which are located adjacent shoulders 45*a* and 45*b* are not movable and are stationary. Thus, as shown, those ends may be captured in pockets 120*a*, 120*b* provided in upper housing cover 14. Due to the flexibility of the material from which blades 44*a* and 44*b* are made, some bending and wiping of the blades 44 still occurs as wiper portions 40*a* and 40*b* contact the respective blades 44*a* and 44*b*. However, the end points of blades 44*a* and 44*b* are held stationary in this embodiment.

Figure 8:
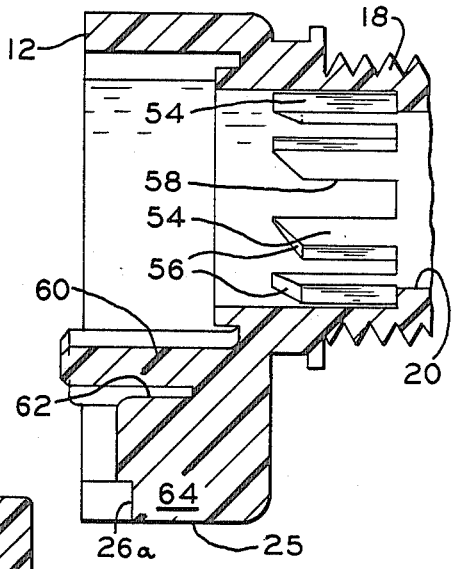
FIG. 8 is a cross sectional view of the upper housing portion of the switch of FIG. 1 taken along lines 8—8 of FIG. 4.

Referring further to FIG. 4, it can be seen that the bore 20 of housing portion 14 includes a number of elongated ribs 54 spaced at equal intervals around the circumference of the bore thereby forming guideways 58 between the ribs. As best seen in FIG. 8, the frontal ends of ribs 54 include diagonal shoulders 56 defining camming rams. Further referring to FIGS. 4 and 5, it can be seen that a bight support 60 for terminal 32 is provided whereby the bight 38 is captured in the slot 62 between support 60 and portion 64 of the housing upper portion 14. The dimple 39 of terminal 32 is in frictional contact with bight support 60.

Referring to FIG. 2, push button 22 includes four lugs 66 circumferentially evenly spaced around push button 22. These lugs 66, in the assembled position of push button 22 with upper housing portion 14, slide in guideways 58, thereby preventing push button 22 from rotating with respect to upper housing portion 14. It should be noted that the forward edge of push button 22 includes a toothed camming surface 68 formed by teeth 70.

As further seen in FIG. 2, an actuator 74 includes a stud 76 and a circumferential toothed camming surface 78 formed by teeth 80. Camming surface 78 is the mirror image of camming surface 68 and can fully engage therewith for camming contact under certain operating conditions as further explained hereinafter. Actuator 74 further includes four lugs 82 which have diagonal camming shoulders 84 on the rearward ends thereof. Lugs 82 cooperate with guideways 58 in bore 20 under certain operating conditions to selectively prevent actuator 74 from rotating with respect to housing 12 when lugs 82 are engaged with guideways 58. However, when actuator 74 is moved axially inside bore 20 so that lugs 82 are out of engagement with guideways 58, actuator 74 is free to rotate. Such rotation of actuator 74 is achieved by the camming contact of the camming surfaces 78 and 68 as further explained hereinafter. Actuator 74 also includes a bore 86 including two ribs 88 for purposes further disclosed hereinafter. It should be noted that the circumferential spacing of lugs 66 and teeth 70 is different from the spacing of lugs 82 and teeth 80, so that when lugs 66 and 82 are aligned, teeth 70 and 80 are not aligned. Thus, when lugs 66 and 82 are aligned, there is a circumferential offset, "Y", between teeth 70 and 80 as further explained hereinafter.

Figure 3:
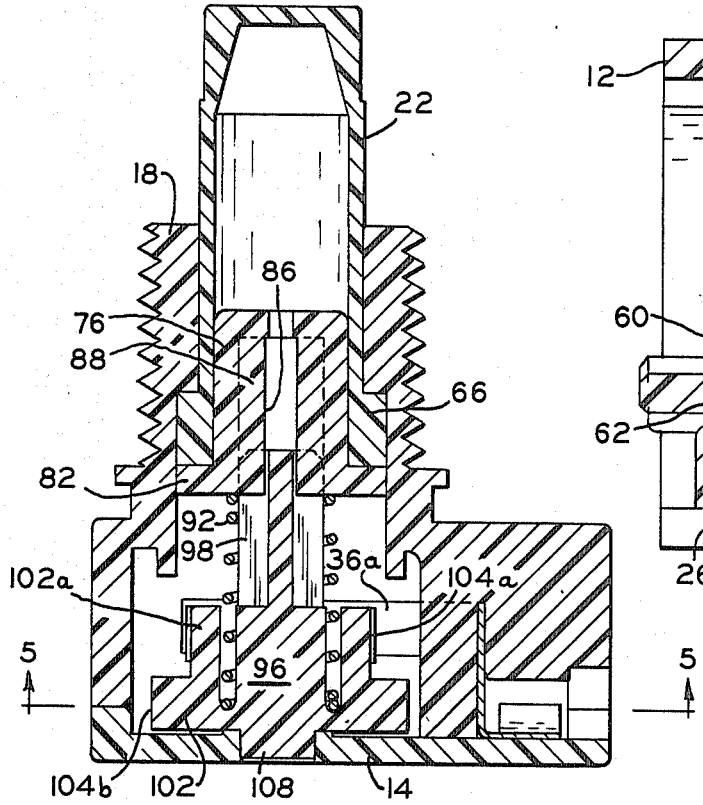
FIG. 3 is a sectional view of the switch assembly of FIG. 1 taken along lines 3—3 thereof.

Still further referring to FIGS. 2 and 3, compression spring 92 is provided to urge actuator 74 axially toward push button 22. A rotor 96 is provided including a stud 98 which slides inside bore 86 of actuator 74 for relative axial movement of actuator 74 with respect to rotor 96. Slots 100 are keyed with ribs 88 to lock actuator 74 and rotor 96 together for rotational movement. However, relative axial sliding moveent between actuator 74 and rotor 96 is possible as further explained hereinafter. Rotor 96 also includes two cams 102*a* and 102*b* which include circumferential camming surfaces 104*a* and 104*b*. Rotor 96 includes a stud 108 at its forward end which fits inside aperture 106 of housing cover 16 to journal rotor 96. Thus rotor 96 is free to rotate but is axially stationary because of the axial biasing action of spring 92.

Figure 9:
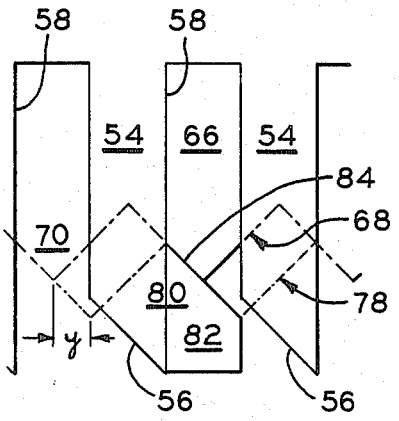
FIGS. 9-12 are enlarged diagrammatic views of the indexing mechanism of the switch of FIG. 1.
Figure 10:
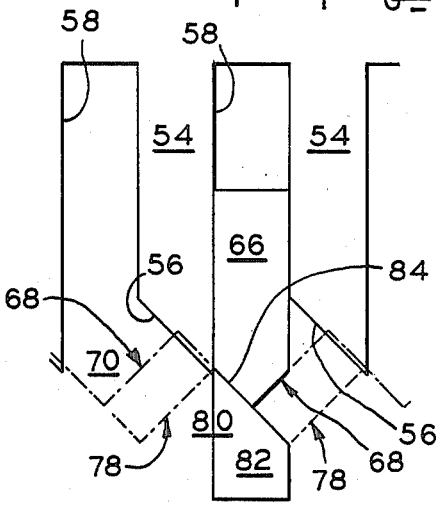
Figure 11:
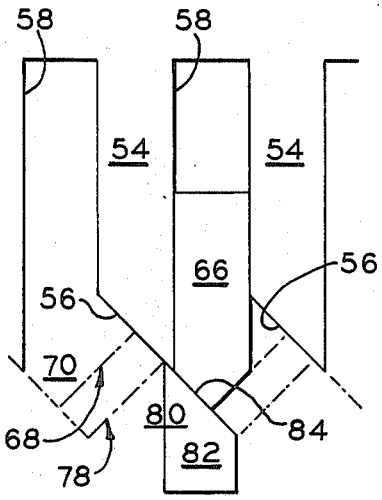
Figure 12:
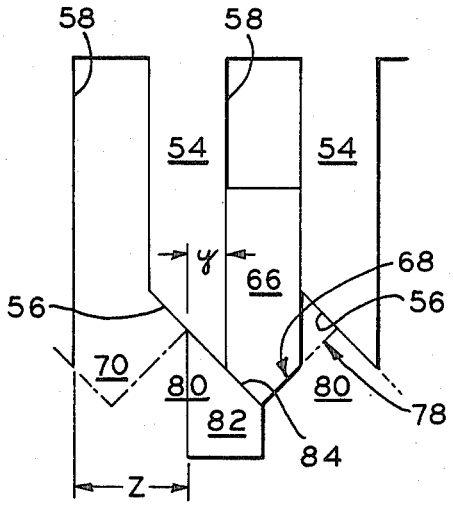

In operation, as best seen by referring to FIGS., 3, 5, and 9–12, let it be assumed that an operator depresses push button 22. This causes forward axial sliding movement of push button 22, thereby causing actuator 74 to also slide forwardly together with push button 22. At this time, lugs 82 and 66 are aligned in guideways 58 and prevent rotation of push button 22, actuator 74 and rotor 96 since these elements are rotationally locked together. However, teeth 70 and 80 are not aligned because of the circumferential offset, "Y", of lugs 70 and teeth 80 so that there is some axial separation of the camming surfaces 68 and 78 as shown in FIG. 9. Thus the teeth 70 and 80 will touch but are not aligned thus preventing complete contact of their camming surface areas 68 and 78 as best seen in FIG. 9. When lugs 82 of actuator 74, upon continued axial movement of the push button 22, are about to disengage from guideways 58, the orientation of lugs 82 relative to lugs 66 will be as shown in FIG. 10. Slightly further axial forward movement of push button 22 releases lugs 82 from guideways 58 thereby permitting rotational movement of actuator 74. This rotational movement of actuator 74 is generated by the camming action of cam surfaces 68 and 78 and the biasing action of spring 92 which urges the camming surfaces into contact. Thus as the push button 22 advances further, the biasing action of spring 92 forces actuator 74 into further contact with push button 22. Actuator 74 will actually be axially stationary but rotates at this point in the operation as shown in FIG. 11, whereas push button 22 continues its forward travel. Actuator 74 carries rotor 96 rotationally along with it until the camming surfaces 68 and 78 are fully engaged and thus causes the rotor camming surfaces 104 to rotate through a predetermined angle of rotation as determined by the offset "Y" between lugs 66 and 82 relative to teeth 70 and 80. Ihe offset angle is shown in FIG. 9 and FIG. 12 as "Y" The angle of rotation has been selected to be approximately 11°. However, it should be understood that this angle could vary. For purposes of the embodiment disclosed herein the range of the predetermined angle of rotation upon actuation of the push button 22 is selected to be from 8°–20°.

The camming surfaces 68 and 78 will now be in complete contact upon completion of this initial rotary motion of actuator 74 as best seen in FIG. 12. It should be noted that in this configuration, when the push button 22 is fully depressed, lugs 82 and 66 are misaligned by offset "Y". Lugs 66 at this time will still be engaged with guideways 58. However, lugs 82 have been released from guideways 58. Rotor 96 will have rotated through 11° of rotation whereby rotor camming surfaces 104*a* and 104*b* will have moved only a slight amount along terminal legs 36, thereby maintaining switch contact of terminal 36*b* and blade 44*b* as shown on the left hand side of FIG. 5 and keeping terminal 36*a* and blade 44*a* out of contact as shown on the right hand side of FIG. 5. Thus the amount of preselected rotation of rotor 96 is such that the switch does not change states and that the switch contacts maintain their open or closed position, as the case may be, during the forward movement of push button 22. It should also be noted that this method of operation prevents intermittent operation of the switch. If the operator merely touches the switch button 22 or if vibration of the structure of which the switch is a part causes the push button to move slightly downwardly the switch will not change states.

If push button 22 is now released and is permitted to travel back to its rest position, spring 92 also urges actuator 74 axially toward its rest or stable position. Camming shoulders 84 of lugs 82 now contact camming shoulders 56 of ribs 54 in bore 20, thereby causing actuator 74 to rotate and causing lugs 82 to become aligned with guideways 58. Further axial and rotary movement of actuator 74 causes lugs 82 to enter guideways 58. Further rotation of rotor 74 is now prevented by the engagement of lugs 82 with guidways 58. Since actuator 74 is rotationally locked to rotor 96 no further rotary motion of rotor 96 is possible.

In the preferred embodiment, the second segment of rotary motion of rotor 96 shown as "Z" in FIG. 12, is chosen to be an angle of approximately 34°. However, it should be understood that the angle for this segment of rotation may vary. For purposes of the embodiment disclosed herein the range of the angle is selected as 30°–50°.

The rotary motion of camming surface 104 through angle "Z" permits the opening of the previously closed switch contacts 36*a* and 44*b* and permits the closing of the previously open switch contacts 36*b* and 44*b*. At this point in the operation of the switch, push button 22 and actuator 74 will again be axially separated and the final position of those two elements is as shown in FIG. 9.

Figure 17:
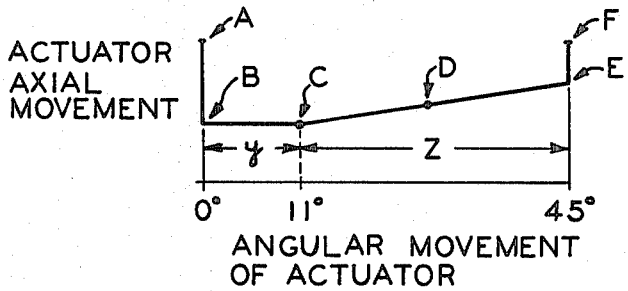
FIG. 17 is a graphical representation of the axial movement versus the angular movement of the actuator of the switch in FIG. 1.

FIG. 17 is a graphical representation of the axial movement of the actuator 74 plotted versus the angular movement of the actuator. The total angle of rotation of the actuator 74 for one actuation of the push button 22 is shown as 45°. However, the total angle of rotation for one operation of the push button may be varied to be any number comprising 360° divided by a whole integer.

Referring further to FIG. 17, it can be seen that the actuator begins its travel at point A when lugs 82 are disposed in guideways 58 and pushbutton 22 is in its rest position. Therefore actuator 74 can only travel axially downwardly. However when actuator 74 reaches position B when lugs 82 disengage from guideways 58, actuator 74 is able to rotate while push button 72 continues its further downward movement. The teeth 80 of actuator 74, during the interval from point B to point C, will become aligned with teeth 70 of push button 22. The interval from B to C is shown as the circumferential offset Y in FIG. 9.

Push button 22 will now bottom out and no further rotation of actuator 74 will occur because camming surfaces 68 and 78 will be in complete aligned contact. It should also be noted, that as the actuator 74 reaches point C, no change of state of the switch will as yet have taken place because the initial rotation of actuator 74 and cam 96 which is rotationally fixed to actuator 74 is insufficient to cause a change of state to occur.

When push button 22 is released from its displaced position and is permitted to return to its rest position, actuator 74 will move axially due to the restoring force of springs 92 and will continue to rotate because camming shoulders 84 of lugs 82 contact camming shoulders 56 of ribs 54 in bore 20. This rotational movement of actuator 74 will continue until lugs 82 have entered guideways 58 which occurs at point E. During the interval C-E of angular movement of actuator 74 which is indicated by "Z" in FIG. 12, rotor 96 will rotate sufficiently so that the switch changes states as shown by point D. Thus it is only during the return of the push button to the rest position that the switch changes states. Thus, the switch structure positively prevents intermittent switch actuation because the switch button must be depressed sufficiently to change states on its return stroke for the actuator to cause the cam to make or break the switch contacts. The last interval of travel E-F of actuator 74 is axial only as the actuator follows the push button to its rest position.

It should be understood that the complete movement of the switch occurs very quickly and that the making and breaking of the switch therefore occurs very rapidly, thereby reducing arcing of the switch contacts to a minimum.

It should also be understood that while in the illustrated embodiment two switch poles have been shown namely one on the right hand side and one on the left hand side of the switch as shown in FIG. 5, a single pole switch could be provided by simply removing either blade 44*a* or 44*b*. Furthermore, it should be understood that by adding further camming surfaces to rotor 96 and by adding further legs to terminal 32 in additional planes, the switch could be caused to include further poles and could control further circuits.

Figure 14:
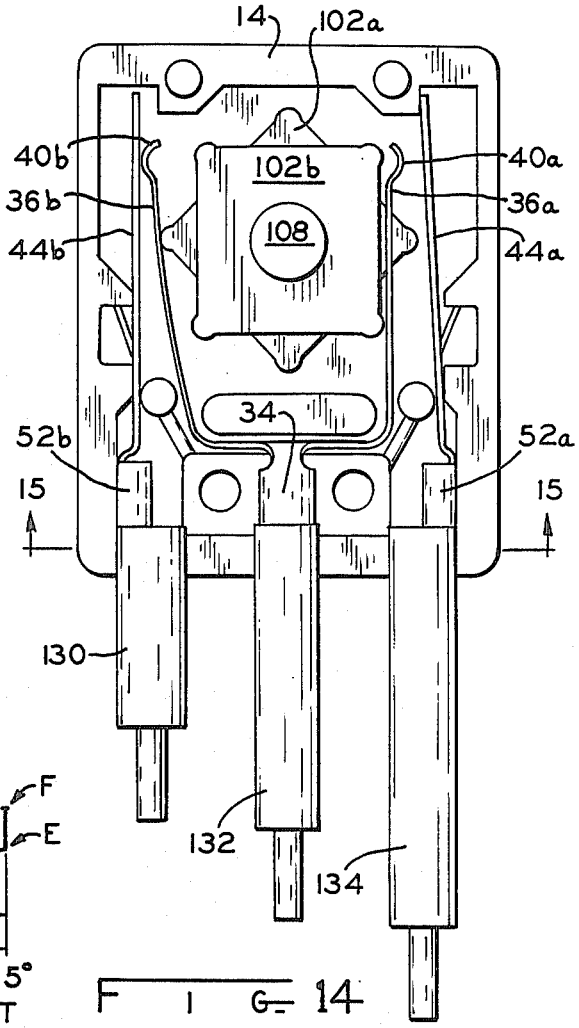
FIG. 14 is a cross sectional view of yet another alternative embodiment of the switch assembly.
Figure 15:
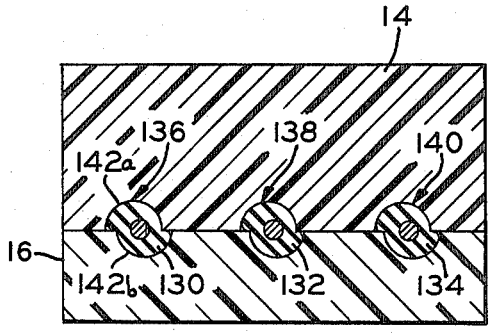
FIG. 15 is a cross sectional view of the switch assembly of FIG. 14 taken along line 15—15.
Figure 16:
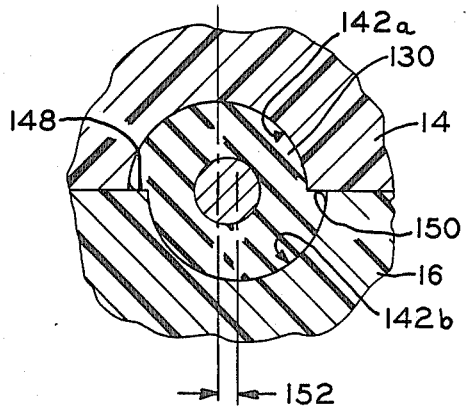
FIG. 16 is an enlarged detail of an aperture shown in the cross sectional view of FIG. 15.

Referring now to FIGS. 14, 15 and 16, an alternative embodiment of the invention is shown wherein provision is made for securely retaining the connecting leads of the switch between the housing upper portion 14 and cover 16. Leads 130, 132 and 134 are shown in FIG. 14 respectively connected to connecting ears 52*b*, 34 and 52*a*. As can be seen in FIGS. 15 and 16, three apertures 136, 138 and 140 are provided for admitting the leads into the housing 12. These apertures are formed by recesses 142*a* and 142*b* which are respectively formed in housing upper portion 14 and cover 16. The centerline of each semi-cylindrical recess 142*a* is offset from the centerline of semi-cylindrical recess 142*b* by an amount indicated at 152, thereby forming a pair of shoulders or projections 148 and 150 which extend into the apertures 136–140. The circumference of leads 130–134 is only slightly smaller than the diameter of apertures 136–140. Further, the insulating covering of leads 130–134 is resilient and flexible. Thus, when leads 130–134 are located within apertures 136–140, shoulders 148 and 150 provide pinch points along the cylindrical axis of the leads to pinch the outer insulation layer of the leads thereby preventing axial removal of the leads by axial forces applied thereto. Thus, to remove the leads, upper housing portion 14 should first be removed from cover 16, thereby releasing pinching pressure on leads 130–134.

While this invention has been described as having a preferred embodiment, it will be understood that it is capable of further modifications. This application is therefore intended to cover any variations, uses, or adaptations of the invention following the general principles thereof and including such departures from the present disclosure, as comes within known or customary practice in the art to which this invention pertains and falls within the limited of the appended claims.

What is claimed is:

1. A push button electrical switch for selectively interconnecting a plurality of electrical conductors by operating a push button, said switch comprising:

a housing including a generally cylindrical first bore therein;

a push button axially slidingly received in said first bore, said push button having a rest position and adapted to be displaced from said rest position during a displacement stroke by a displacement force and to be returned to said rest position during a return stroke by a restoring force;

an actuator axially movably disposed with respect to said push button, said actuator adapted to slide axially only relative to said first bore during an initial predetermined displacement of said push button from said rest position and thereafter to rotate with respect to said housing upon further axial movement of said push button during said displacement stroke;

a rotor axially movably disposed and rotationally fixed with respect to said actuator, said rotor including a switch camming surface disposed radially outwardly from the axis of rotation of said rotor;

a blade disposed adjacent said camming surface; and a terminal disposed between said blade and said switch camming surface and biased resiliently inwardly toward said switch camming surface, whereby, upon axial movement of said push button during said return stroke, said switch camming surface selectively engages said terminal for movement toward said blade in a plane which is substantially transverse to the axis of said rotor and thereby causing said terminal to contact said blade or permits said terminal to resiliently move away from said blade and thereby breaking contact between said terminal and blade.

2. The switch according to claim 1 wherein said housing includes a plurality of axially elongated radially inwardly extending ribs spaced evenly around the circumference of said first bore and defining first guideways therebetween, said push button including a plurality of first lugs spaced around a circumference of said push button and adapted to be received in said first guideways to prevent rotation of said push button relative to said housing, said actuator including a plurality of second lugs spaced around the circumference of said actuator and adapted to be selectively received in said first guideways for selectively preventing rotation of said actuator relative to said housing.

3. The switch according to claim 2 wherein a first end of said push button includes a generally circular first toothed camming surface, and wherein the actuator includes a generally circular second toothed camming surface adapted to selectively engage with said first camming surface for causing said actuator to be rotatingly indexed, a bias spring urging said first and second toothed camming surfaces into engagement, whereby, upon said predetermined displacement of said push button from said rest position during said displacement stroke, said second lugs are disengaged from said first guideways and the engagement of said first and second toothed camming surfaces causes said actuator to rotatingly index through a first predetermined angle.

4. The switch according to claim 3 wherein first ends of said ribs include shoulders defining first camming ramps, second ends of said second lugs include shoulders defining second camming ramps, whereby when said push button returns to said rest position, said bias spring urges said first and second camming ramps into engagement thereby initiating rotation of said actuator in a preselected direction and thereafter urges said second lugs into said first guideways whereby said actuator is rotatingly indexed through a second predetermined angle.

5. The switch according to claim 4 wherein said first predetermined angle is in a range of 8° to 20° and said second predetermined angle is in a range of from 30° to 50°.

6. The switch according to claim 4 wherein contact between said terminal and blade is made or broken only during rotation of said actuator through said second predetermined angle.

7. The switch according to claim 1 wherein said actuator includes a second bore having second guideways therein, said rotor including a splined stud slidingly received in said second bore.

8. The switch according to claim 1 wherein said terminal is cantilevered in said housing.

9. The switch according to claim 1 wherein said terminal is bifurcated and includes a plurality of cantilevered legs, the legs of said terminal straddling said rotor, said rotor including a plurality of camming surfaces for respective engagement with said plurality of legs, said switch further including a plurality of blades for respective engagement with said plurality of respective legs.

10. The switch according to claim 9 wherein said legs are disposed in a plurality of planes, said planes oriented at substantially right angles to the axis of said push button.

11. The switch according to claim 1 wherein said housing comprises a concave body and a cover therefor, the mating surfaces of said body and cover each including a recess, said respective recesses forming a lead aperture for admitting an electrical lead into said housing, a projection in one of said recesses adapted to extend into said aperture for pinching said electrcial lead and preventing axial movement of said lead.

12. The switch according to claim 1 wherein radial outward movement of said terminal toward said blade causes the terminal to wipe across at least a portion of said blade during establishment or breaking of electrical contact therewith.

13. A push button electrical switch for selectively interconnecting a plurality of electrical conductors, said switch comprising:

a housing including a generally cylindrical first bore therein;

an elongated push button axially slidingly received in said first bore, a first end of said push button including a generally circular first camming surface, said push button having a rest position and adapted to be displaced from said rest position by a displacement force and to be returned to said rest position by a restoring force;

an actuator axially movably arranged with respect to said push button for axial movement only of said actuator during an initial displacement of said push button from said rest position, said actuator having a generally circular second camming surface for engaging said first camming surface and thereby causing said actuator to rotate with respect to said housing upon occurrence of a predetermined amount of axial displacement of said push button from said rest position;

a rotor axially movable with respect to the actuator and rotatingly fixed relative thereto, said rotor including a switch camming surface disposed radially outwardly of the axis of rotation of said rotor;

a blade disposed adjacent to and resiliently biased toward said switch camming surface; and a cantilevered terminal disposed between said blade and said switch camming surface, whereby upon rotation of said rotor only during return of said push button to said rest position from said predetermined displacement, said terminal moves radially inwardly or outwardly in response to rotation of said camming surface thereby causing at least a portion of said teminal to wipe across at least a portion of said blade and making or breaking said switch.

14. The switch according to claim 13 wherein said housing includes a plurality of axially elongated radially inwardly extending ribs spaced evenly around the circumference of said first bore and defining first guideways therebetween, said push button including a plurality of first lugs spaced around its circumference for slideable engagement in said first guideways and for preventing rotation of said push button relative to said housing, said actuator including a plurality of second lugs spaced around its circumference and adapted to be selectively received in said first guideways for selectively preventing rotation of said actuator relative to said housing.

15. The switch according to claim 14 including a bias spring for urging said first and second circular camming surfaces into engagement, whereby, upon depression of said push button, said actuator second lugs disengage from said first guideways, and the engagement of said first and second circular camming surfaces causes said actuator to rotatingly index through a first preselected angle.

16. The switch according to claim 15 wherein first ends of said ribs include shoulders defining first camming ramps, second ends of said second lugs including shoulders defining second camming ramps, whereby, upon release of said push button, said bias spring urges said first and second camming ramps into engagement and causes said actuator to rotate in a preselected direction and index through a second preselected angle.

17. The switch according to claim 16 wherein contact between said terminal and said blade is made or broken only during rotation of said actuator through said second preselected angle.

18. The switch according to claim 13 wherein said actuator includes a second bore having second guideways therein, said rotor including a splined stud slidably received in said second bore.

19. The switch according to claim 13 wherein said terminal comprises a pair of bifurcated cantilevered legs which straddle said rotor, said rotor including a pair of camming surfaces for respective engagement with said plurality of legs, said switch further including a plurality of blades for respective engagement with said legs, said legs being disposed in a plurality of planes oriented at substantially right angles to the axis of said push button.

20. The switch according the claim 13 wherein said housing comprises a concave body and a cover therefor, mating surfaces of said body and coverage including a recess, said respective recesses forming a lead aperture for admitting an electrical lead into said housing, a projection on one of said recesses adapted to extend into said aperture for pinching said electrical lead and preventing axial movement of said lead.

21. A push button electrical switch for selectively interconnecting a plurality of electrical conductors, said switch comprising:

a housing having a generally cylindrical first bore therein and a plurality of elongated, evenly spaced, radially inwardly extending, first ribs arranged circumferentially around said first bore and defining first guideways therebetween, first ends of said ribs including shoulders defining first camming ramps;

an elongated cylindrical push button axially slidably received in said first bore and having evenly spaced lugs arranged around the circumference thereof for sliding cooperation with said first guideways and preventing rotation of said push button relative to said housing, a first end of said push button including a generally circumferential toothed first camming surface, said push button having a rest position and a displacement position;

an actuator slidably and rotatably associated with said housing and including a generally cylindrical toothed second camming surface for cooperating with said first camming surface and causing said actuator to selectively rotatingly index through a first preselected angle with respect to said housing, said actuator including a plurality of second lugs for cooperating with said first guideways and selectively preventing rotation of said actuator with respect to said housing, the ends of said second lugs defining second camming ramps adapted to cooperate with said first camming ramps for rotatingly indexing said actuator through a second preselected angle;

resilient means for urging said actuator toward said push button;

a rotor axially movably disposed with respect to said actuator and rotationally locked thereto, said rotor including a switch camming surface circumferentially arranged with respect to the axis of said first bore;

a blade in said housing disposed radially outwardly of said switch camming surface;

a cantilevered terminal disposed between said blade and switch camming surface and arranged, only upon rotation of said rotor through said second preselected angle, to be selectively cammed into and out of contact with said blade for opening or closing said switch.

22. The switch according to claim 21 wherein, upon movement of said push button from said rest position by a predetermined distance, said actuator second lugs disengage from said first guideways whereupon the camming engagement of said first and second toothed camming surfaces causes said actuator to rotatingly index through said first preselected angle and, upon return of said push button from said displacement position to said rest position, said actuator slides axially with respect to said housing and is rotated through said second preselected angle by camming engagement of said first and second camming ramps.

23. The switch according to claim 22 wherein said first preselected angle is approximately 8° to 20° and said second preselected angle is approximately 30° to 50°.

24. The switch according to claim 22 wherein said push button returns to the rest position after each actuation and release.

25. The switch according to claim 21 wherein said terminal is bifurcated and includes a plurality of legs, the legs of said terminal straddling said actuator, said actuator including a plurality of camming surfaces for respective engagement with said plurality of legs, said switch further including a plurality of blades for respective engagement with said plurality of legs, said legs being disposed in a plurality of planes oriented at substantially right angles to the axis of said actuator.

26. The switch according to claim 21 wherein said actuator includes a second bore having second guideways therein, said rotor including a splined stud slidingly received in said second bore.

27. The switch according to claim 21 wherein the radial outward movement of said terminal towards said blade causes the terminal to wipe across at least a portion of said blade during establishment or breaking of electrical contact therewith.

28. The switch according to claim 21 wherein said housing comprises a concave body and a cover therefor, mating surfaces of said body and cover each including a recess, said respective recesses forming a lead aperture for admitting an electrical lead into said housing, a projection on one of said recesses adapted to extend into said aperture for pinching said electrical lead and preventing axial movement of said lead.

29. A pushbutton switch having a return biased axially movable button having a rest position and an axially movable, rotary actuator which rotationally indexes a chosen angle with each depression of the button, the button and rotary actuator movable along a button axis, the improvement comprising:

a housing;

a rotary switch mounted within the housing, the rotary switch including:

a stationary first electrical contact element mounted to the housing;

a movable, resilient second electrical contact element mounted to the housing near the first contact element, the second contact element biased away from the first contact element in a plane perpendicular to the button axis; and a rotary cam rotationally mounted within the housing coaxially with the button axis, the rotary cam including a cam surface configured to bias the second contact element against the first contact element when the rotary cam is at an on rotary position so as to cause electrical connection between the first and second contact elements, the rotary cam configured to permit the resilient second contact element to move away from the first contact element when the rotary cam is at an off rotary position; and drive means for rotationally coupling/axially decoupling the rotary actuator and the rotary cam so as to substantially prevent relative rotational movement between the rotary actuator and rotary cam while permitting relative axial movement therebetween, so that rotation of the rotary actuator rotates the rotary cam and moves the rotary cam between the off and on rotary positions only during the return of said axially moveable button to its rest position.

* * * * *